US009226356B1

(12) United States Patent
Mart et al.

(10) Patent No.: US 9,226,356 B1
(45) Date of Patent: Dec. 29, 2015

(54) USING INDIVIDUAL CLUSTER-LEVEL POWER REGULATION CIRCUITS TO EXTEND LED LIGHT LIFE

(71) Applicants: Gary K. Mart, Bonita Springs, FL (US); Jose Fernandez, Sunrise, FL (US)

(72) Inventors: Gary K. Mart, Bonita Springs, FL (US); Jose Fernandez, Sunrise, FL (US)

( * ) Notice: Subject to any disclaimer, the term of this patent is extended or adjusted under 35 U.S.C. 154(b) by 0 days.

(21) Appl. No.: 13/730,090

(22) Filed: Dec. 28, 2012

(51) Int. Cl.

| | |
|---|---|
| ***H05B 37/00*** | (2006.01) |
| ***H05B 39/00*** | (2006.01) |
| ***H05B 41/00*** | (2006.01) |
| ***H05B 33/08*** | (2006.01) |

(52) U.S. Cl.
CPC ..... *H05B 33/0845* (2013.01)

(58) Field of Classification Search
None
See application file for complete search history.

(56) References Cited

U.S. PATENT DOCUMENTS

| | | | | |
|---|---|---|---|---|
| 6,236,331 | B1 * | 5/2001 | Dussureault | 340/815.45 |
| 2010/0134020 | A1 * | 6/2010 | Peng et al. | 315/133 |
| 2012/0280617 | A1 * | 11/2012 | Josefowicz et al. | 315/85 |

* cited by examiner

*Primary Examiner* — Anh Tran
(74) *Attorney, Agent, or Firm* — Patents on Demand P.A.; Brian K. Buchheit; Scott M. Garrett

(57) ABSTRACT

A light emitting device can comprise a light emitter for emitting light at a defined light intensity and circuitry connecting a power source to the light emitter. The circuitry can adjust power provided to the light emitter over time to compensate for inefficiencies due to circuit and light emitter degradation. A more consistent light intensity of the emitted light over a life of the light emitting device and an improved life expectancy of the light emitter can be achieved than what would result if the power was not adjusted over time to offset degradation effects.

17 Claims, 7 Drawing Sheets

340

345

USING INDIVIDUAL CLUSTER-LEVEL POWER REGULATION CIRCUITS TO EXTEND LED LIGHT LIFE

BACKGROUND

The present invention relates to the field of lighting and, more particularly, to using individual cluster-level power regulation circuits to extend light-emitting diode (LED) light life.

Recent trends have made it commonplace to replace energy-inefficient incandescent and fluorescent light bulbs with energy-efficient light-emitting diode (LED) bulbs. The benefits of LED light bulbs include low energy consumption, long life, low heat production, slow failure, and the ability to be quickly cycled on and off. The life of an LED light is affected by environmental variables like temperature and operational variables like current and voltage. These variables are often difficult to control, particularly in large indoor spaces (i.e., industrial lighting) or outdoor spaces (i.e., streetlights) and systems where the LED lights have been retrofitted.

Heat sinks are generally used to address the issue of temperature fluctuations, while power conversion and/or regulation circuitries are used to control power fluctuations. However, conventional power regulation approaches address the LED light as a whole. This approach is insufficient for high-powered LED light fixtures that support multiple, distinct clusters or arrangements of LEDs like those taught in U.S. Patent Application GTL12001.

The conventional approach assumes that the LED arrangements are identical in composition (e.g., quantity of LEDs) as well as usage. Such an approach would drastically decrease the overall performance of the LED light fixtures described in U.S. Patent Application GTL12001. That is, the power regulation for an LED arrangement having seven LEDs will be different than the power regulation for an LED arrangement having three LEDs. Treating these LED arrangements identically, in terms of power regulation, will affect the performance of the LEDs of the arrangements.

BRIEF SUMMARY

One aspect of the present invention can include a light emitting device comprising a light emitter for emitting light at a defined light intensity and circuitry connecting a power source to the light emitter. The circuitry can adjust power provided to the light emitter over time to compensate for inefficiencies due to circuit and light emitter degradation. A more consistent light intensity of the emitted light over a life of the light emitting device and an improved life expectancy of the light emitter can be achieved than what would result if the power was not adjusted over time to offset degradation effects.

Another aspect of the present invention can include a method where a light emitting device can adjust power supplied to a light emitter over time to compensate for circuit degradation effects. A more consistent light intensity of the emitted light over a life of the light emitting device can be achieved than what would result if the power was not increased over time to offset circuit degradation effects.

Yet another aspect of the present invention can include a method for independently regulating current to LED clusters. Such a method can begin when a control signal is received by a master power controller to activate one or more LED clusters of an LED light fixture. Each LED cluster can be comprised of multiple LEDs electrically connected in series and arranged in a circular configuration. The master power controller can provide a power signal to the power regulation circuit of each LED cluster. The provided power signal can be adjusted over time by the power regulation circuit of each LED cluster to compensate for circuit degradation effects. A more consistent light intensity of the emitted light over a life of the light emitting device can be achieved than what would result if the power was not increased over time to offset circuit degradation effects. The LED cluster can then be powered with the adjusted power signal.

DETAILED DESCRIPTION

The present invention discloses a power regulation circuit that can automatically and dynamically compensate for degradation experienced over time by the LED light. The power regulation circuit can be implemented at the cluster-level to allow for individualized compensation in configurations where multiple LED lights are contained in the same fixture and may have different operating variables over time. The power regulation circuit can be configured to compensate for an optimum LED life and/or a specific level of luminance.

As will be appreciated by one skilled in the art, aspects of the present invention may be embodied as a system, method or. Accordingly, aspects of the present invention may take the form of an entirely hardware embodiment or an embodiment combining software (including firmware, resident software, micro-code, etc.) and hardware aspects that may all generally be referred to herein as a "circuit," "module" or "system". Aspects of the present invention are described below with reference to flowchart illustrations and/or block diagrams of methods and/or apparatus (systems) according to embodiments of the invention.

Figure 1:
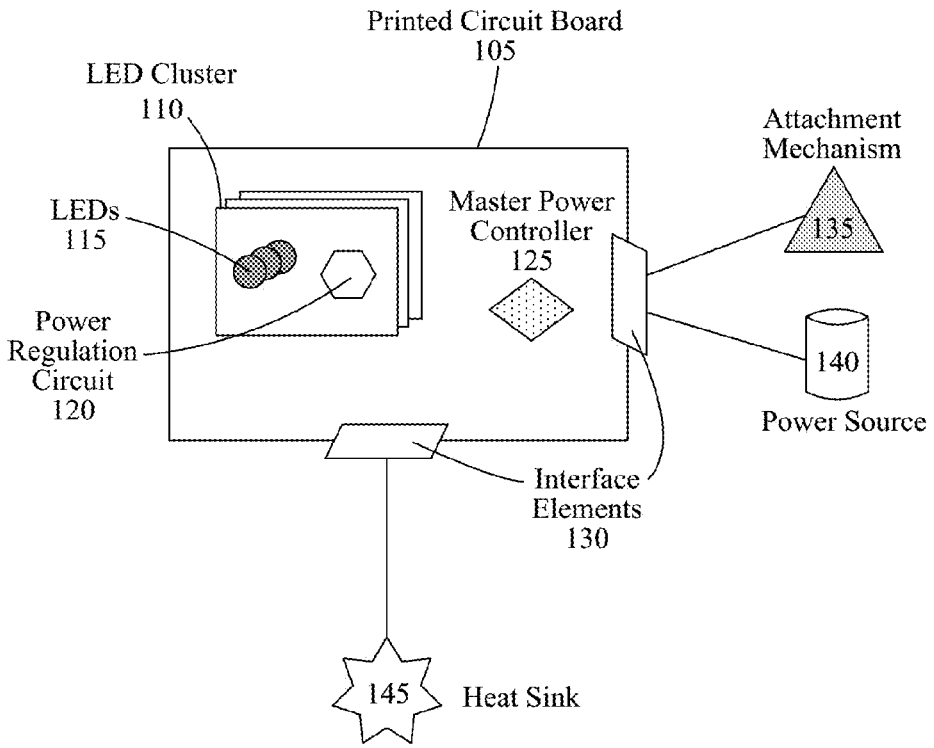
FIG. 1 is a block diagram illustrating a light-emitting diode (LED) light fixture that utilizes cluster-level power regulation circuits in accordance with embodiments of the inventive arrangements disclosed herein.

FIG. 1 is a block diagram illustrating a light-emitting diode (LED) light fixture 100 that utilizes cluster-level power regulation circuits 120 in accordance with embodiments of the inventive arrangements disclosed herein. The LED light fixture 100 can be designed for high-power applications, indoor and/or outdoor, where luminance is desired at distances of 100 ft. or more. Example applications of the LED light fixture 100 can include, but are not limited to, streetlights, industrial (e.g., warehouse, factories, etc.) lighting systems, office lighting systems, sports stadiums, parking lots/garages, and the like.

The LED light fixture 100 can have a primary component comprised of a printed circuit board 105. The printed circuit board 105 can be manufactured in accordance with standard methods that acceptable for use with LED technology. Components coupled to a surface of the printed circuit board 105 can include multiple LED clusters 110, a master power controller 125, and interface elements 130.

In another contemplated embodiment, the LED light fixture 100 can have an alternate primary component to which multiple printed circuit boards 105 can be attached; each printed circuit board 105 can support an LED cluster 110, while the master power controller 125 and interface elements 130 can be elements of the alternate primary component.

For example, the alternate primary component can be a plastic disc having receptacles in which the printed circuit board 105 of each LED cluster 110 can be placed. The disc can have openings for wiring and/or connection points (i.e., interface elements 130) for each LED cluster 110 to be connected to the master power controller 125 and/or other necessary elements.

The LED clusters 110 can be positioned upon the printed circuit board 105 in a predetermined configuration. Each LED cluster 110 can include multiple LEDs 115 and a power regulation circuit 120. The arrangement of LEDs 115 in an LED cluster 110 can be detailed in U.S. Patent Application GTL12001.

The quantity of LED clusters 110 included in the LED light fixture 100 can vary based on intended application and/or design. Further, LED clusters 110 having different quantities of LEDs 115 can be incorporated onto the same printed circuit board 105. That is, the LED clusters 110 contained on the printed circuit board 105 need not be homogenous.

The LEDs 115 of the LED cluster 110 can be produced in accordance with standard semiconductor manufacturing practices and can have characteristics (e.g., color, luminance, power consumption, size, etc.) applicable for the specific type of LED light fixture 100. For example, LUXEON REBEL (LXML-PWC1-100) LEDs 115 can be used.

Figure 1A:
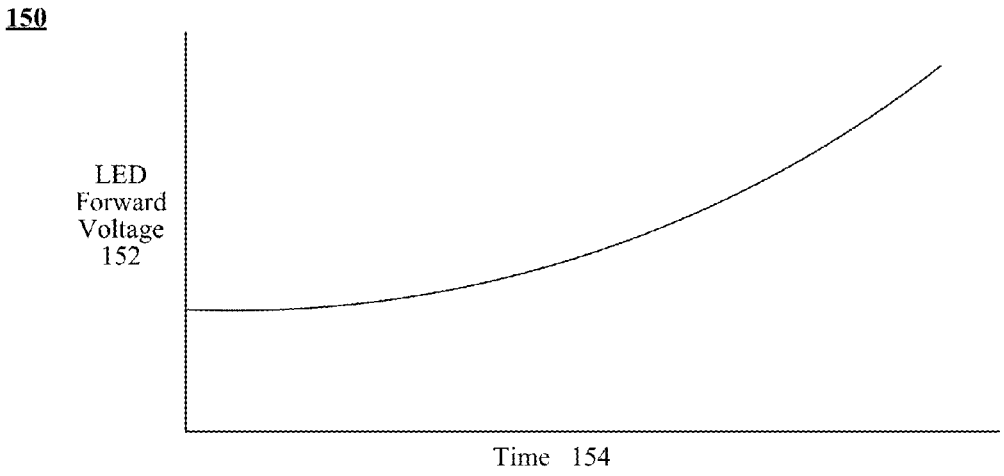
FIG. 1A is a graph illustrating LED degradation over time.
Figure 1B:
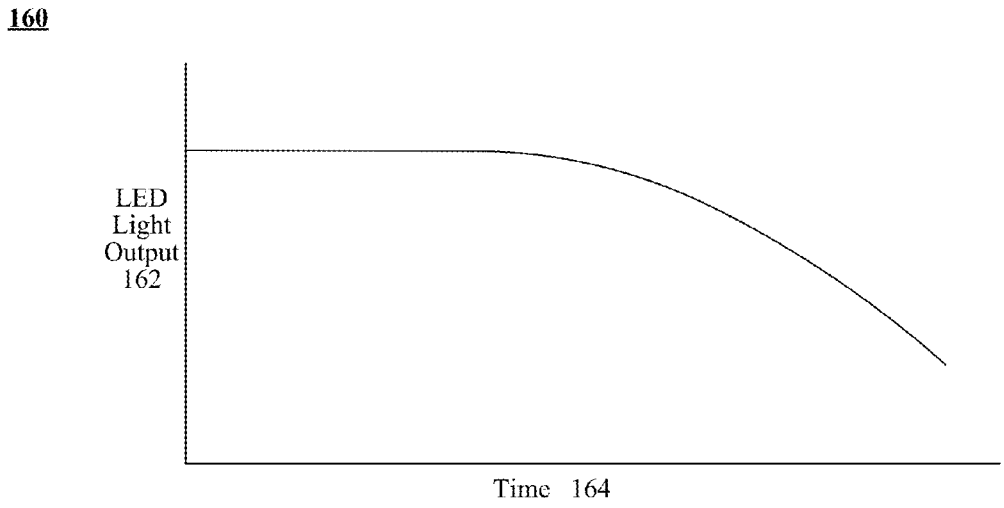
FIG. 1B is a graph illustrating the decrease in LED light output as a result of degradation and aging over time.
Figure 1C:
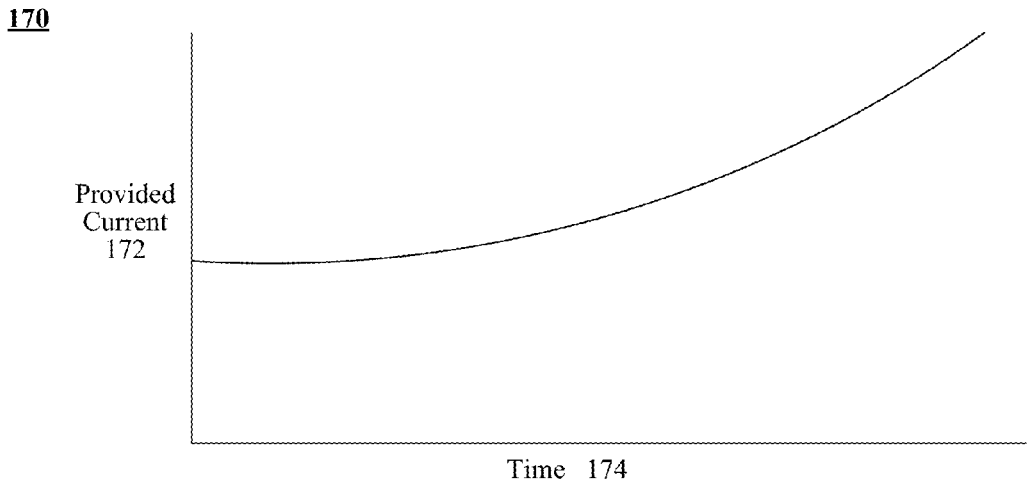
FIG. 1C is a graph illustrating the current provided by the power regulation circuit to compensate for degradation over time.
Figure 1D:
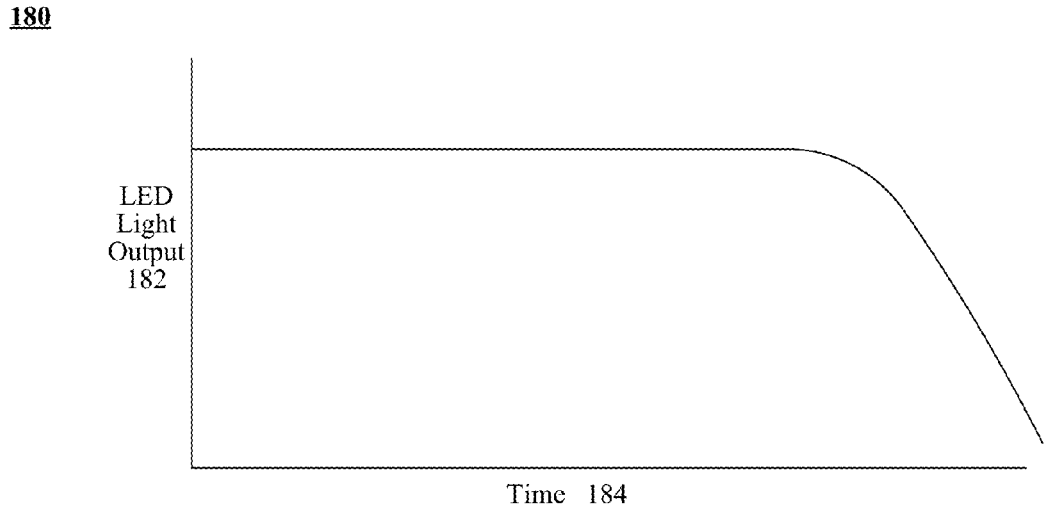
FIG. 1D is a graph illustrating the LED output over time as a result of the compensation provided by the power regulation circuit.

The power regulation circuit 120 can regulate the current received by the LEDs 115 of the LED cluster 110 from the master power controller 125 to compensate for LED 115 aging and/or environmental factors. The effect of aging and/or environmental factors can manifest within the operating parameters of the LED 115 and/or LED cluster 110 in various ways, as shown by the graphs 150 and 160 of FIGS. 1A and 1B. Graph 150 can illustrate how the forward voltage 152 required by the LED 115 to operate can increase over time 154 due to circuit degradation and/or aging. As a result, the light output 162 of the LED 115 can decrease or dim over time 164, as shown in graph 160.

The power regulation circuit 120 can be designed to detect changes to the most common affected parameters like light output, temperature, and forward voltage. The compensation provided by the power regulation circuit 120 can be for optimizing the life of the LED cluster 110 and/or producing a constant level of luminance. For example, the forward voltage of the LEDs 115 can be 3.0 Vdc and can require a current of 700 mA to produce 4000 lumens. The power regulation circuit 120 can then adjust the voltage and/or current to maintain these parameter values. If the forward voltage needed for the LEDs 115 starts to decrease, over time, the power regulation circuit 120 can compensate by increasing the supplied voltage to compensate for the decrease, if better LED 115 life is desired, or by adjusting the current, if constant lumen output is desired.

Conventional power regulation circuits can typically only regulate one parameter (current or voltage) to a predetermined, fixed value. The power regulation circuit 120 of the present invention can provide better regulation and flexibility over conventional implementations.

Graphs 170 and 180 can show the effect of the compensation of the power regulation circuit 120. Compensating for the increasing required forward voltage 152 shown in graph 150, graph 170 can illustrate how the power regulation circuit 120 can correspondingly increase the current 172 it provides to the LED 115 over time 174. Such compensation can then stabilize the light output 182 of the LED 115 over time 184 as shown in graph 180, as opposed to the uncompensated curve shown in graph 160.

Operation of the power regulation circuit 120 of each LED cluster 110 can be governed by the master power controller 125. The master power controller 125 can be an electronic component that controls the power distributed to the power regulation circuits 120 of the LED clusters 110 from the power source 140.

It is important to emphasize that the current supplied to the LEDs 115 of each LED cluster 110 can be individually adjusted to meet the needs of the specific LED cluster 110 regardless of the power supplied by the master power controller 125, allowing optimal operation of the LEDs 115. For example, the master power controller 125 can be configured to provide all LED clusters 110 with the same current. The power regulation circuit 120 can then adjust, increase or decrease, the current to achieve the appropriate voltage for the number of LEDs 115 in the LED cluster 110.

This approach can allow for LED clusters 110 having different quantities of LEDs 115 to be incorporated into a LED light fixture 100 and driven by a single power signal. Conventional power regulation can be performed at the LED light fixture 100 level and would be unable to provide this granular level of control to support multiple LED clusters 110 of different types or LED 115 compositions.

Further, the conventional approach cannot provide adequate regulation for LED clusters 110 that have different usage times. For example, in a four-LED cluster 110 LED light fixture 100, all four LED clusters 110 can be used when the LED light fixture 100 is "ON" and each pair of LED clusters 110 can be activated by separate motion sensors when the LED light fixture 100 is "OFF". Thus, each pair of LED clusters 110 can accumulate different amounts of usage time, depending on how often each motion sensor is triggered. Over time, the LED clusters 110 that are more frequently activated can require more adjustment to the power signal by the power regulation circuit 120 to compensate for loss than the other pair of LED clusters 110.

The interface elements 130 can represent a variety of items required to couple the printed circuit board 105 to other components like a heat sink 145, attachment mechanism 135, and power source 140. For example, the attachment mechanism 135 can be coupled to the printed circuit board 105 via a housing using screws 130.

A heat sink 145 can be used to dissipate excess heat generated by the LED clusters 110 as well as counteract heat from the external environment. This can be of particular importance due to the temperature-sensitivity of the LEDs 115 with respect to performance as well as the high-power nature of the application (i.e., more power tends to equal more heat).

The attachment mechanism 135 can represent the mechanical components require to affix the LED light fixture 100 to a desired physical location within an appropriate fixture or mounting surface. The attachment mechanism 135 can include elements that retrofit the LED light fixture 100 into existing, non-LED lighting systems.

The power source 140 can provide the LED light fixture 100 with power. The power source 140 can be a stand-alone element like a solar panel or battery, or can be a connection to a commercial power network. The power source 140 can be capable of providing the LED light fixture 100 with power in a specified operating range.

Figure 2:
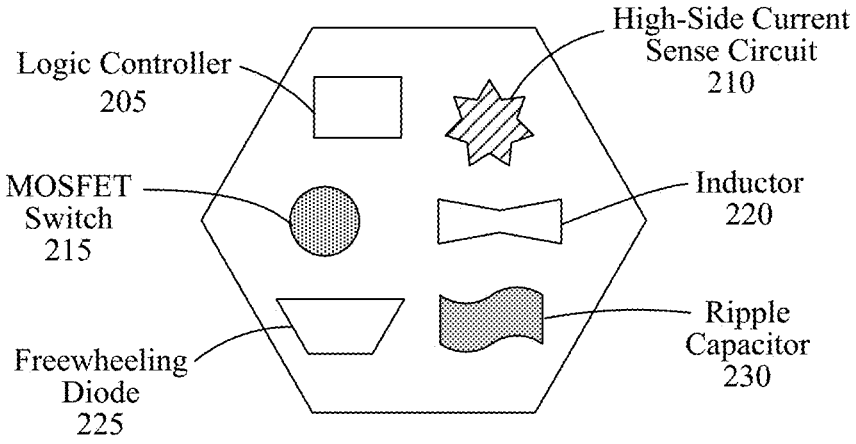
FIG. 2 is a block diagram illustrating the components of the cluster-level power regulation circuit in accordance with an embodiment of the inventive arrangements disclosed herein.

FIG. 2 is a block diagram illustrating the components of the power regulation circuit 200 in accordance with embodiments of the inventive arrangements disclosed herein. The power regulation circuit 200 can be utilized within the context of the LED light fixture 100 of FIG. 1.

The power regulation circuit 200 can include a logic controller 205, high-side current sense circuit 210, a metal-oxide semiconductor field effect transistor (MOSFET) switch 215, an inductor 220, a freewheeling diode 225, and a ripple capacitor 230. As the operation of these components is well known in the art, their specifics will not be discussed herein.

However, it should be noted that many conventional power regulation circuits lack a ripple capacitor 230. The use of a ripple capacitor 230 in this improved power regulation circuit 200 can prevent high current switching noises from feeding back to the logic controller 205. This feedback can be the source of poor current regulation and inconsistent performance in conventional power regulation circuits.

Figure 3:
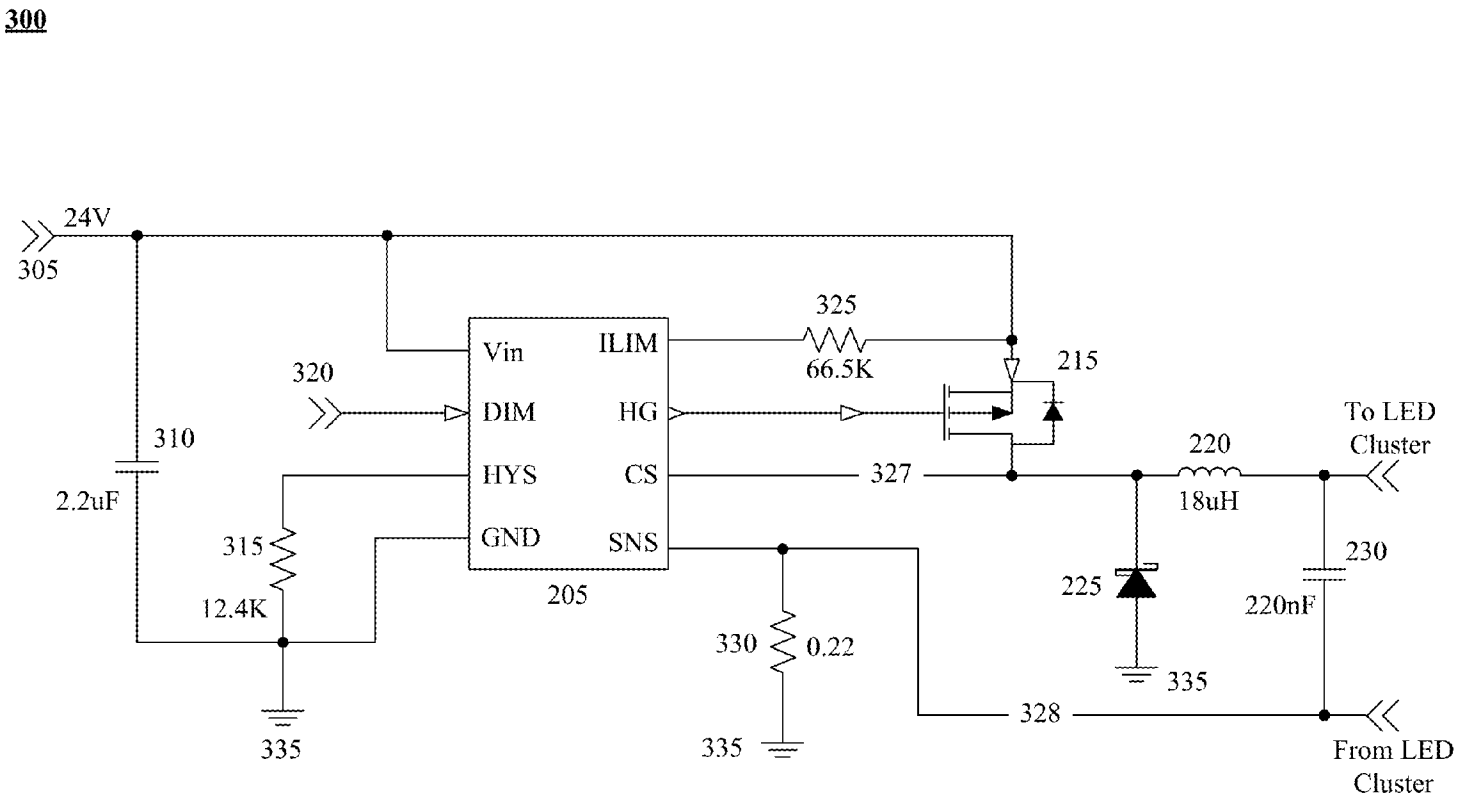
FIG. 3 is a circuit diagram for a sample topology for a portion of the power regulation circuit in accordance with an embodiment of the inventive arrangements disclosed herein.

FIG. 3 is a circuit diagram 300 for a sample topology for a portion of the power regulation circuit in accordance with embodiments of the inventive arrangements disclosed herein. Circuit diagram 300 can be for illustrative purposes and is not meant as an exhaustive or limiting representation of the power regulation circuit.

Figure 3A:
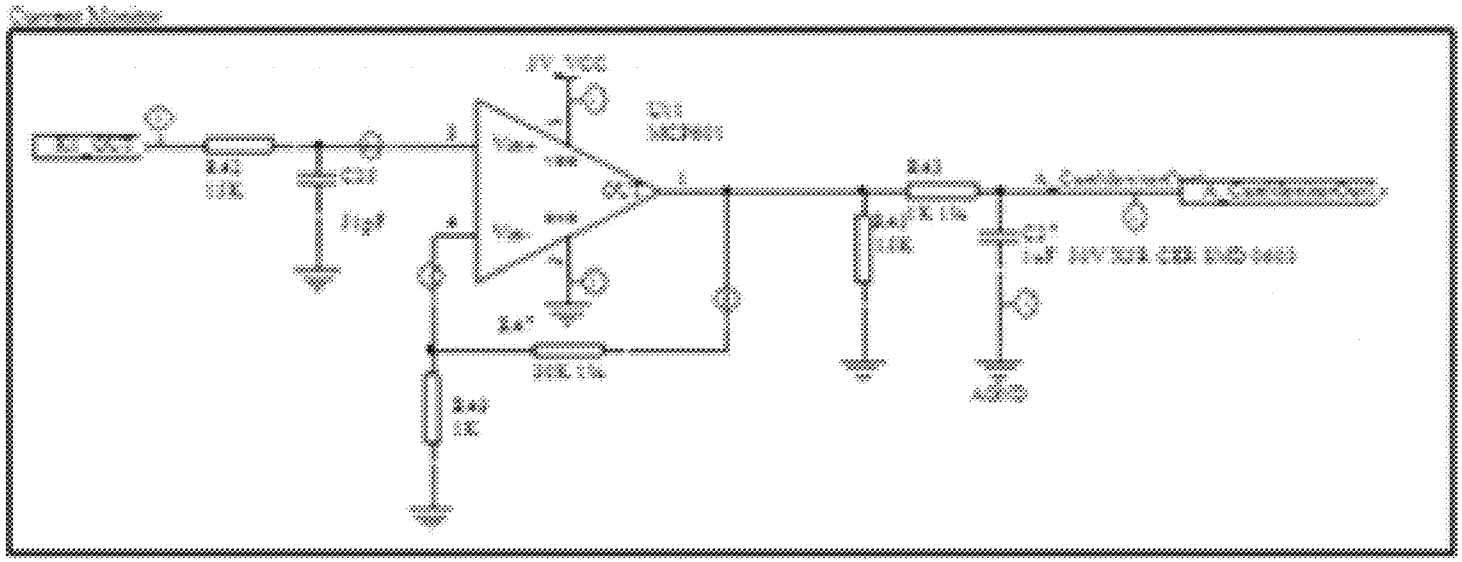
FIG. 3A is a circuit diagram of the high-side current sense circuit.
Figure 3B:
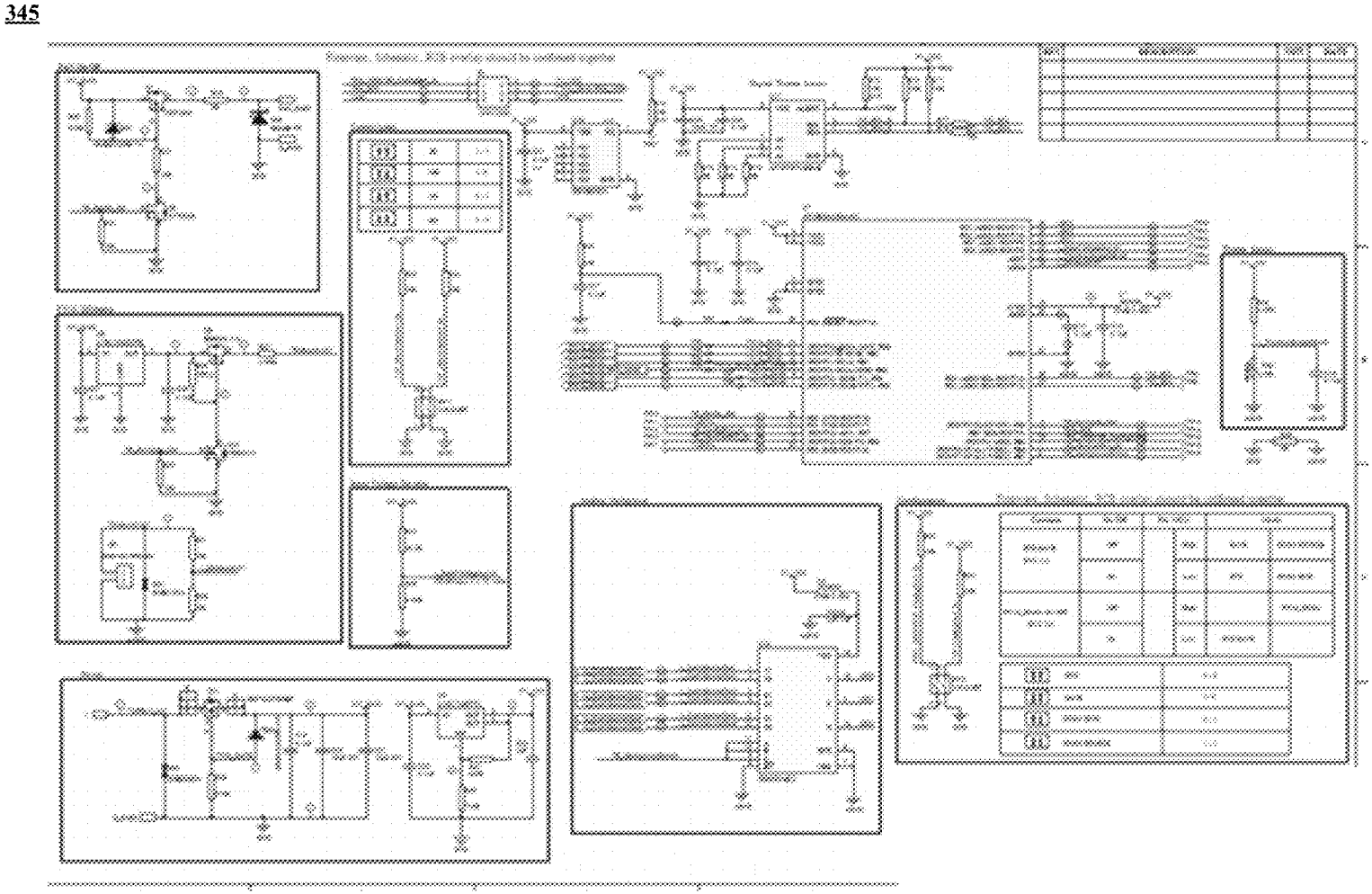
FIG. 3B is a detailed example of the power regulation circuit that can be used to implement an energy savings program for an LED light.

The power regulation circuit of diagram 300 can be connected to the current high-side current sense circuit 340 of FIG. 3A. FIG. 3B can illustrate a more detailed example 345 of the power regulation circuit that can be used to implement an energy savings program for the LED light.

In this example, the power regulation circuit of circuit diagram 300 can be used with an LED cluster of seven LUXEON REBEL (LXML-PWC1-100) LEDs. Power supply input 305 to the power regulation circuit can be 24V. The power supply input 305 can be connected to the appropriate pin (Vin) of the logic controller 205. In this example, the logic controller 205 can be a hysteretic PFET controller for high power LEDs (LM3401MM). A 66.5 kΩ resistor 325 can be connected to the power supply input 305 and current limiting pin (ILIM) of the logic controller 205.

An input capacitor 310 can be connected to the power supply input 305 and ground 335. A 12.4 kΩ resistor 315 can be connected to the hysteresis pin (HYS) of the logic controller 205 and ground 335 to set the hysteretic limit. The ground pin (GND) of the logic controller 205 can also be connected to ground 335. A separate dimmer input signal 320 can be connected to the dimmer pin (DIM) of the logic controller 205, when dimmer functionality is implemented in the LED light fixture.

Activation of the LED cluster can be controlled by the output signal of the gate drive pin (HG) of the logic controller 205 and the MOSFET switch 215 (FDC5614P). When conditions for activating the LED cluster are met, current can flow out of the MOSFET switch 215 and onto the line 327 that connects to the current sensing pin (CS) of the logic controller 205 and the LED cluster.

The freewheeling diode 225 can be connected to line 327 and ground 335. Line 327 can also include an 18 uH inductor 220. Line 327 can then continue to the LED cluster with line 328 returning from the LED cluster. Line 328 can be connected to the current feedback pin of the logic controller 205. A 220 nF ripple capacitor 230 can connect lines 327 and 328 to reduce noise feedback. A 0.22Ω resistor 330 can also be connected to line 328.

The flowchart and block diagrams in the Figures illustrate the architecture, functionality, and operation of possible implementations of systems and/or methods according to various embodiments of the present invention. It should also be noted that, in some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts, or combinations of special purpose hardware and computer instructions.

What is claimed is:

1. A light emitting device comprising:

a light emitter for emitting light at a defined light intensity; and circuitry connecting a power source to the light emitter, wherein said circuitry adjusts power provided to the light emitter over time to compensate for inefficiencies due to circuit and light emitter degradation, thereby achieving a more consistent light intensity of the emitted light over a life of the light emitting device and an improved life expectancy of the light emitter than what would result if the power was not adjusted over time to offset said degradation effects, wherein power adjustments over time made by a power regulation circuit connected to the circuitry are in accordance with a fixed profile curve for adjusting current over time to compensate for the circuit degradation effects.

2. The light emitting device of claim 1, wherein the light emitter is at least one light-emitting diode (LED) designed for the defined light intensity.

3. The light emitting device of claim 2, wherein the at least one LED is part of an LED cluster having a plurality of LEDs electrically connected in series, wherein the plurality of LEDs are physically arranged in a circular configuration.

4. The light emitting device of claim 1, wherein the light emitter comprises a plurality of light emitters, wherein the power increase for each light emitter is independently controlled.

5. The light emitting device of claim 4, wherein at least one of the plurality of light emitters has a different rate of circuit degradation, wherein the circuitry provides a different power increase to the at least one light emitter having the different rate of circuit degradation.

6. The light emitting device of claim 1, further comprising:

a power regulation circuit connected to the circuitry, wherein the power regulation circuit increases the power supplied to the light emitter over time to compensate for circuit degradation effects.

7. The light emitting device of claim 1, wherein the increases in power over time increase current while holding voltage substantially constant.

8. The light emitting device of claim 1, wherein adjustments in power are limited to a range defined for the power supply causing power adjustment for consistent light intensity to function for a span of time for the light emitting device, wherein after the span of time, no further adjustments are possible and the light intensity produced by the light emitter will degrade in accordance with further circuit degradation effects.

9. The light emitting device of claim 1, wherein the circuitry provides for calibration of the power adjustments, permitting sampling of output light intensity and a changing of power adjustments to ensure the output light intensity is a desired level.

10. A method comprising:

a light emitting device adjusting power supplied to a light emitter over time to compensate for circuit degradation effects, thereby producing a more consistent light intensity from the light emitting device over time and an improved life expectancy of the light emitter than possible in absence of adjusting power over time, wherein adjustments to the power over time are made in accordance with a fixed profile curve for adjusting current over time to compensate for the circuit degradation effects.

11. The method of claim 10, wherein adjusting the power over time comprises increasing current over time while keeping voltage substantially constant.

12. The method of claim 10, wherein adjustments to the power over time are automatically made by a power regulation circuit.

13. The method of claim 10, further comprising:

measuring the light intensity output by the light emitting device; and adjusting the power supplied to the light emitting device in order to change the light intensity output to a rated light intensity.

14. The method of claim 10, wherein the power supplied to the light emitting device is manually adjusted, wherein the manually adjusted power becomes a desired light intensity to which subsequent power adjustments to the light emitting device for circuit degradation effects are to meet.

15. A method for independently regulating current to LED clusters comprises:

receiving of a control signal by a master power controller to activate a plurality of LED clusters of an LED light fixture, wherein each LED cluster comprises a plurality of LEDs electrically connected in series, wherein the plurality of LEDs are arranged in a circular configuration;

providing of a power signal by the master power controller to a power regulation circuit of each LED cluster;

adjusting of the provided power signal over time by each power regulation circuit for each LED cluster to compensate for circuit degradation effects, thereby producing a more consistent light intensity from the light emitting device over time and an improved life expectancy of the light emitter than possible in absence of adjusting power over time, wherein the adjusting of the provided power signal is based upon a fixed profile curve for adjusting current over time to compensate for the circuit degradation effects; and powering the LED cluster with the adjusted power signal.

16. The method of claim 15, wherein the adjusting of the provided power signal over time comprises increasing current over time while keeping voltage substantially constant.

17. The method of claim 15, further comprising:

measuring the light intensity output by the LED cluster; and adjusting the power supplied to the LED cluster in order to change the light intensity output to a rated light intensity.

* * * * *